United States Patent [19]

Call

[11] Patent Number: 4,758,184

[45] Date of Patent: Jul. 19, 1988

[54] FUSED PLUG FOR ELECTRICAL APPLIANCE CORD

[76] Inventor: Wilson Call, P.O. Box 1328, Bakersfield, Calif. 93301

[21] Appl. No.: 94,154

[22] Filed: Sep. 8, 1987

[51] Int. Cl.[4] ..... H01R 13/68

[52] U.S. Cl. ..... 439/622; 337/197

[58] Field of Search ..... 337/197, 198, 201, 213; 439/621, 622

[56] References Cited

U.S. PATENT DOCUMENTS

| | | | |
|---|---|---|---|
| 2,636,096 | 4/1953 | DiBlasi | 200/115.5 |
| 2,988,617 | 6/1961 | Graziosi | 200/115.5 |
| 3,218,413 | 11/1965 | Koch | 337/197 |
| 3,699,500 | 10/1972 | Borzoni et al. | 439/622 |
| 4,080,039 | 3/1978 | Ahroni | 337/197 |
| 4,176,902 | 12/1979 | Bernstein | 337/198 |
| 4,196,409 | 4/1980 | Juba | 337/198 |
| 4,274,698 | 6/1981 | Ahroni | 337/198 |
| 4,275,374 | 6/1981 | Chancer | 337/197 |
| 4,307,925 | 12/1981 | Drew | 337/198 |
| 4,309,069 | 1/1982 | Ahroni | 337/198 |
| 4,350,407 | 9/1982 | Tong | 337/262 |
| 4,418,978 | 12/1983 | Shamir | 439/622 |
| 4,420,214 | 12/1983 | Wu | 337/198 |
| 4,480,891 | 11/1984 | Wu | 337/198 |
| 4,575,704 | 3/1986 | Pezold | 439/622 |

FOREIGN PATENT DOCUMENTS

| | | | |
|---|---|---|---|
| 134652 | 10/1946 | Australia | 337/213 |
| 2146847 | 3/1973 | Fed. Rep. of Germany . | |
| 1259497 | 1/1972 | United Kingdom . | |

*Primary Examiner*—Gil Weidenfeld
*Assistant Examiner*—Gary F. Paumen
*Attorney, Agent, or Firm*—Kenneth J. Hovet

[57] ABSTRACT

An electrical plug housing is provided having a base part and a fuse part. Both parts fit together and secure electrical contact members that provide male and female plug connections. One of the members comprises two sections each of which are in engagement with a fuse connector. The housing fuse part includes transverse openings which extend from a compartment in the housing face. One end of the fuse connector extends through the transverse opening and engages one of the contact member sections. The opposing end provides a clamp for one end of a fuse.

8 Claims, 2 Drawing Sheets

FUSED PLUG FOR ELECTRICAL APPLIANCE CORD

BACKGROUND OF THE INVENTION

1. Field of the Invention

The present invention relates to electrical devices that protect against overloaded circuits and, more particularly, to fused plugs for appliance cords.

2. Description of the Prior Art

The advisability of using fused plugs for household appliances is well established. In 1981, the National Fire Protection Association reported 38,520 fires resulted from appliance shorts. In 1982, there were 56,790 such fires. One reason for the above is that small appliances generally have an 18 AWG wire cord with a maximum load of 5 amp and 600 watts at 120 volts. Most house wiring is 12 AWG with a 20 amp circuit breaker. At 120 volts, the breaker won't open until 2400 watts are reached. Since this greatly exceeds the appliance cord capability, the cord will overheat and incinerate unless protected by a fuse.

Electrical plugs with built-in fuse devices have been developed as a convenient way to overcome the above-described problem. U.S. Pat. No. 2,636,096 describes a plug-in receptacle wherein a conventional tubular glass bodied fuse is incorporated into the plug circuitry. U.S. Pat. Nos. 2,988,617 and 4,275,374 utilize a similar arrangement with the same type of fuse in an insertion and ejection channel. This avoids having to dismantle the plug to replace the fuse.

The fuse ejection channel plugs have a significant problem, however, in forming a reliable connection between the fuse contacts and the plug contact parts. Axial positioning of the fuse is imprecise. Also, firm engagement of the respective contacts is often precarious, is generally weak and, at the least, creates unwanted electrical resistance.

For added convenience, a rotatable fuse assembly is shown in U.S. Pat. No. 4,196,409. When a fuse blows, a slotted hub is rotated to bring on-line a fresh fuse. Unfortunately, this device requires multiple radially extending conductors with associated fuse elements and circuitry. U.S. Pat. No. 4,309,069 also shows a rotatable fuse device comprising a conductive foil on opposing faces of a rotatable plastic body. Design objectives of each of the above devices is convenience and simplicity of use. However, the cost for such convenience is high and plug reliability is low.

SUMMARY OF THE INVENTION

An electrical fitting is provided that incorporates an internal fuse system that is reliable, simple to use and easily manufactured. Fuse engagement is firm, positive and visually confirmable. Plug contact connections is accomplished in a durable secure manner without wires, fasteners, solder or manual guesswork.

The invention utilizes a unique fuse connector means that is readily assembled to a fixed position within the plug housing. It functions to securely grip a conventional fuse while also providing steadfast electrical communication with plug male/female contact members. Advantages of the fuse connector means is realized through its cooperating relationship with an apertured wall of a fuse compartment and its engagement with plug contact securement means. Significant advantage is achieved through use of the inherent resilience and bendability of conventional electrically conductive materials.

DESCRIPTION OF THE PREFERRED EMBODIMENTS

Figure 1:
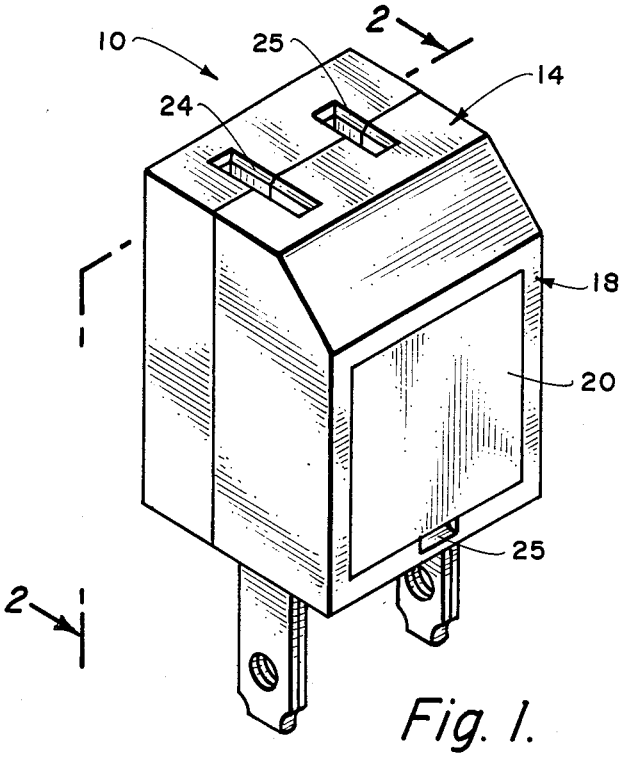
FIG. 1 is a front perspective view of the fused electrical plug of the present invention.
Figure 3:
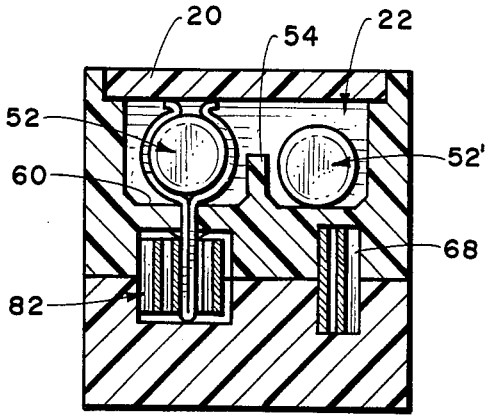
FIG. 3 is a cross-sectional view taken along lines 3—3 of FIG. 2.
Figure 2:
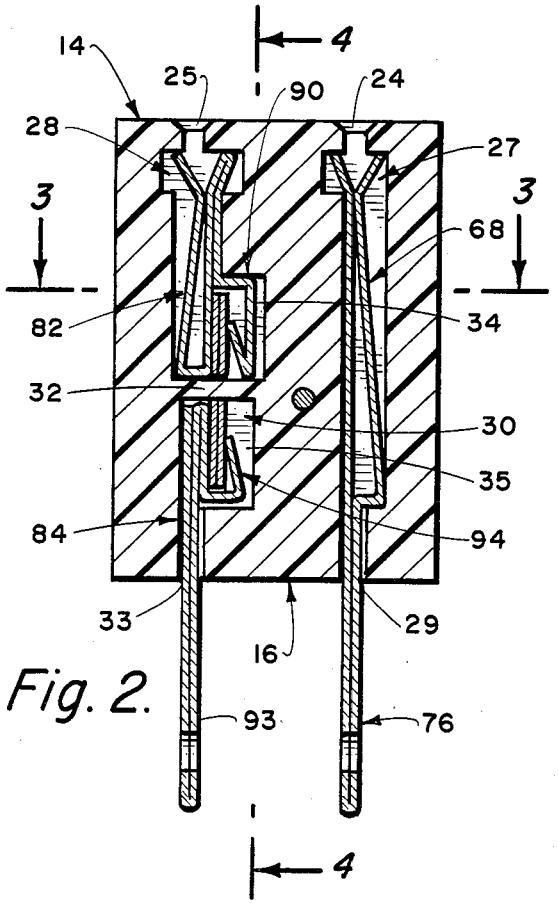
FIG. 2 is a cross-sectional view taken along lines 2—2 of FIG. 1.
Figure 4:
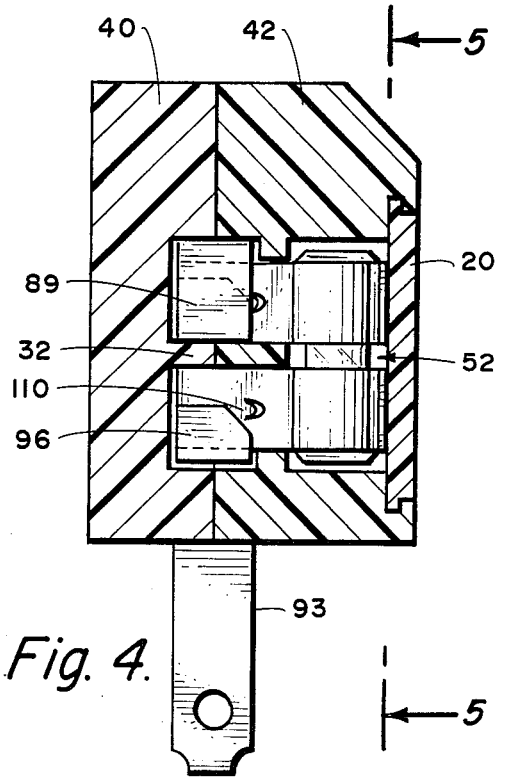
FIG. 4 is a cross-sectional view taken along lines 4—4 of FIG. 2.

With reference now to the drawings, FIG. 1 illustrates an embodiment of the overall fused plug assembly 10 of the invention. The plug comprises a housing with a solid body portion of insulative material having an upper face 14 and lower face 16. A front face 18 includes removable cover 20 that overlies fuse compartment 22.

The housing upper face is provided with inlets 24,25 for first and second contact openings 27,28, respectively. The first contact opening 27 extends from inlet 24 through the housing length to a first outlet 29 in lower face 16. The second contact opening 28 is located in the housing upper half and does not communicate with lower face 16.

A third contact opening 30 is provided which is separated below the second opening by housing partition 32. The opening extends to a second outlet 33 on the lower face. Both the second and third openings include enlarged areas 34,34, respectively, for a purpose to be hereinafter described.

Figures 5, 6:
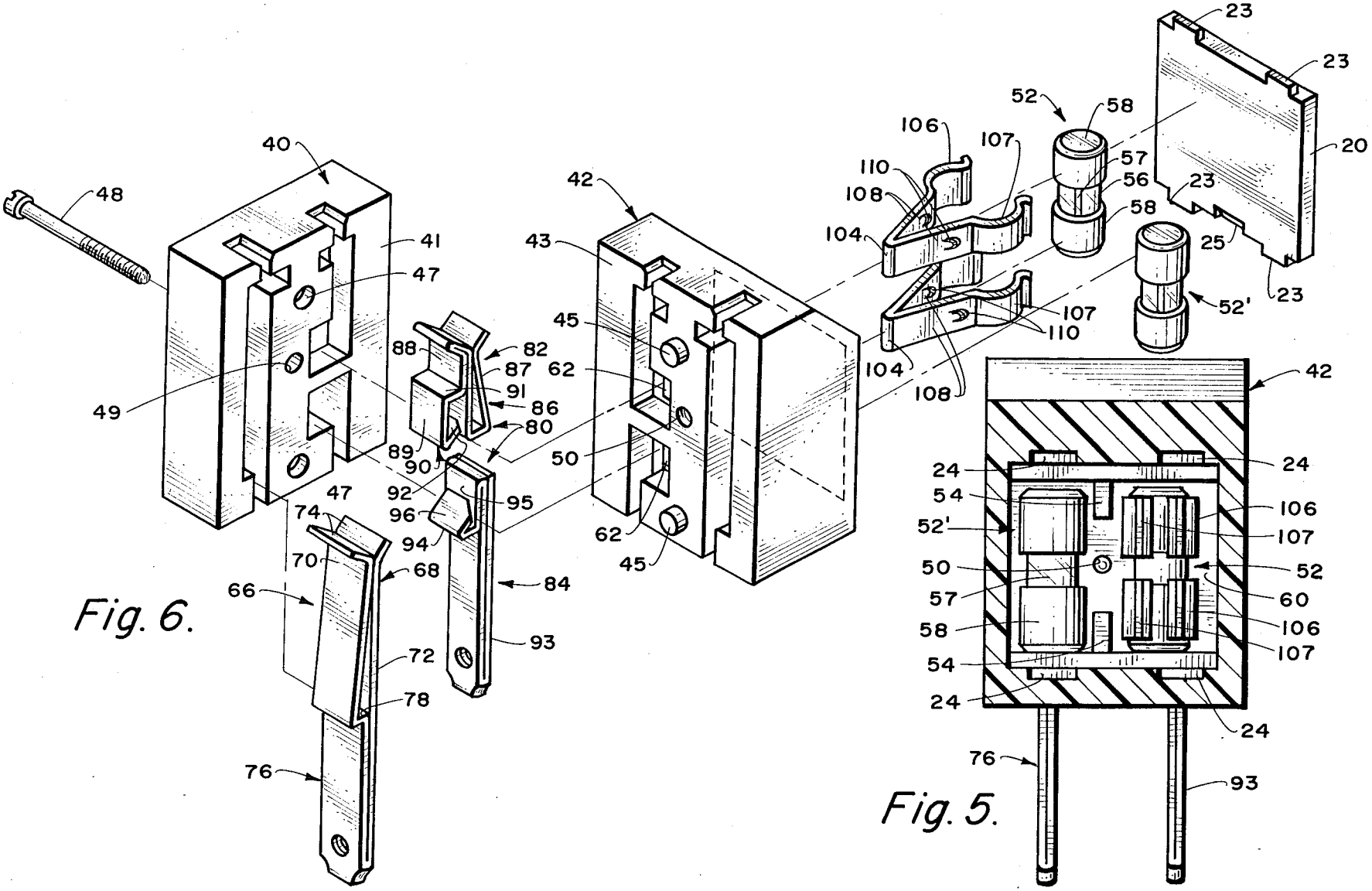
FIG. 5 is a cross-sectional view taken along lines 5—5 of FIG. 4.
FIG. 6 is an exploded perspective view showing assembly of the parts forming the plug of FIG. 1.

As best shown in FIG. 5, the plug housing is composed of a base part 40 and fuse part 42. Each part has a matching inner face 41,43, respectively, that come together to form the completed plug body. The contact openings are formed thereby as a result of corresponding mirror-image partial openings on each inner face. Alignment of the parts during assembly is insured by posts 45 entering corresponding orifices 47. The parts are held together by fastener 48 extending through base part fastener opening 49 and engaging fuse part threaded opening 50.

Fuse compartment 22 is shown as a rectangular-shaped recess extending into face 18. It should be sized to hold at least one fuse device 52 and, preferably, have room for storage of a spare 52'. In such case, dividers 54 can be used to separate the devices.

As shown, the fuse devices are of conventional design having a glass tubular body 56 with opposing end contact caps 58. A fusable element 47 in the body connects the caps and conducts electricity unless the current exceeds a predetermined amount.

Without being limited thereby and by way of example only, it will be noted that the invention is advantageous for use with small appliance cords. In cases where the cord is 18 AWG, an AGA 5 amp 125 volt fuse would be appropriate. For 16 AWG appliance cords, an AGA 10 amp 125 volt fuse would be most effective. Of course, other fuse devices may be used as dictated by the particular electrical requirements of each cord and/or load factor.

The fuse compartment includes an apertured wall which, as shown, comprises back wall 60. The back wall separates the compartment area and fuse devices from the contact openings. Apertures 62 extend through the wall into each of the second and third contact openings. Preferably, at least one aperture extends into a respective enlarged area 34,35.

The compartment cover 20 includes edge tabs 23 which snap into corresponding notches 24 on the outer periphery of the compartment. Detents 25 on the cover and compartment edges are provided for manual engagement and removal of the cover.

Retained within the first contact opening is a first male/female contact member 66. This member provides a female receptacle portion 68 directly below inlet 24. The receptacle portion includes a lever arm 70 biased against support leg 72. When the male prong from an appliance cord plug is inserted into inlet 24, it will force the lever arm away from the support leg and be frictionally engaged therebetween.

The first contact member includes a male contact portion 76 which extends outwardly from outlet 29. The male and female portions comprises a continuum of electrically conductive material. Preferably, the member is formed from a strip of metal which is folded together with a straight double-layer lower section forming the male contact portion 76. At about the midpoint, a shoulder 78 is formed in one of the strip layers which then extends upwardly to form lever arm 70. The other unbent layer forms the support leg 72. Both the lever arm and support leg have coextensive flared ends 74.

The second and third contact openings hold the segmented second contact member 80. The second opening encloses female segment 82 and the third opening retains male segment 84. The segments are separated and electrically isolated from each other by housing partition 32.

Female segment 82 comprises a prong engagement portion 86 which is constructed and operates substantially similar to female receptacle portion 68. It includes an inclined leg 87 which is biased against straight leg 88. The ends of both legs flare outwardly and are located directly below inlet 25 to receive a male prong from an appliance cord.

A strip from the lower part of straight leg 88 is used to form a securement means shown as box portion 90. The strip is first bent outwardly to form ledge 91. It is then bent downwardly to form box wall 89 and then angled inwardly toward the straight leg to form an angle tab 92. The tab is biased toward leg 88 and functions to frictionally engage fuse connector means to be hereinafter described.

Male segment 84 is similar to, and extends from outlet 33 coextensively with, male contact portion 76. It includes a straight prong section 93 having an upper component with a securement means shown as triangular portion 94. A strip of the upper component extends outwardly from a flat part 95. It then inclines upwardly and inwardly to form incline tab 96. The tab is biased toward flat part 95 and operates to frictionally engage a fuse connector means.

It will be noted that both the box and triangular portions are located in a respective enlarged area 34,35 of the housing. Also, note that both the male and female segments are formed from strips of resilient electrically conductive material which are folded together with discrete bends to form the above-described configurations. In this way, the invention effectively utilizes the inherent properties of materials such as copper, aluminum, brass and other similar metals.

The aforementioned fuse connector means extend from the fuse compartment through apertures in the compartment wall and connect with the securement means. As shown, the fuse connector means comprise two electrically conductive resilient connector strips. Each strip is formed into a wedge shape having an apex 104 that serves as a contact engagement end for connection to a respective box or triangular portion 90,94.

In construction, a strip of predetermined length is folded together, preferably about a midpoint, to form wedge portions 108. The opposing strip ends are formed into a fuse engagement portion comprising arcuate ends 106,107. The ends are curved outwardly into annular segments to resiliently clasp respective end caps 58 of the fuse devices. This construction permits the ready engagement and removal of fuse devices as needed.

To assemble the fuse connectors to fuse part 42 of the housing, the wedge portions are squeezed together and inserted into respective upper and lower apertures 62. The aperture openings are configured to correspond closely to the cross-sectional shape of the folded together wedge portions. In this manner, the peripheral edges of each aperture will restrain the wedge portions against their inherent outward bias.

To prevent unwanted withdrawal out of the apertures, each wedge portion is provided with a retention means. As shown, this comprises an abutment flange 110 that extends outwardly from each wedge portion. To inhibit axial movement, the flanges are located on each wedge portion a distance from each arcuate end about equal to the thickness of wall 60.

From the above construction and assembly, it can be seen that the wedging forces of each fuse connector create a dynamic assembly that is exceptionally resistent to vibration and rough use. The associated frictional engagements require only a minimum of parts and assembly labor as compared to the prior art. Further, a more durable and trouble-free plug is produced.

While the invention has been described with respect to a preferred embodiment, it will be apparent to those skilled in the art that various alterations may be made without departing from the scope and spirit of the invention. Accordingly, it is to be understood that the invention is not to be limited by the specific embodiment illustrated, but only by the scope of the appended claims.

I claim:

1. A fused electrical plug comprising:

a housing having at least first, second and third contact member openings and an integral compartment containing a fuse device having a wall unitary with said housing with apertures extending from said compartment to each of said second and third openings;

a first electrical contact member constrained within said first opening and a second contact member comprising two sections, each one being located in a respective second and third opening; and, fuse connector means attached to said fuse device in said compartment and extending from said compartment through said apertures for engagement with a respective said section to provide electrical communication between said sections, said fuse connector means comprising two resilient strips each folded together and formed into a wedge shape having a contact engagement portion comprising the apex of said wedge shape from which extend opposing wedge portions each of which merge into a fuse attachment portion, said wedge shape including an outwardly extending abutment flange for engagement with a respective aperture.

2. The plug of claim 1 wherein each fuse attachment portion is located in said compartment and each contact engagement portion is located in a respective said second and third opening.

3. The plug of claim 2 wherein said fuse device includes at least two electrical fuse contacts with said fuse attachment portion attached to each respective said fuse contact.

4. The plug of claim 3 wherein each section includes securement means for engaging a respective said contact engagement portion.

5. The plug of claim 4 wherein said compartment wall adjoins said openings.

6. A fused electrical plug comprising a housing having upper and lower faces with first and second electrical contact members providing a male or female contact at an upper or lower face, said second contact member segmented into two sections with each section electrically isolated from the other, said housing including an integral fuse compartment containing a fuse having two fuse contacts with a wall unitary with said housing separating the compartment from said two sections; and, fuse connector means extending through said wall having a fuse engagement portion for attachment to said fuse in said compartment and a contact engagement portion for connection with a said contact member section, said fuse connector means comprising an electrically conductive resilient strip having arcuate ends which are folded toward each other about a midpoint bend, said arcuate ends forming said fuse engagement portion and said midpoint bend forming said contact engagement portion, the folded strip between said arcuate ends and said midpoint bend comprising an outwardly biased wedge portion, said wall including an aperture with an opening substantially coextensive with the cross-sectional shape of said midpoint bend with said wedge portion including retention means comprising an abutment flange which is outwardly flared from the wedge portion to engage said wall adjacent said apertures.

7. The plug of claim 6 wherein said wedge portion is biased outwardly against said aperture opening.

8. A fused electrical fitting for an appliance cord comprising:

a body having an integral fuse compartment containing at least one fuse device having opposing fuse contact caps;

contact member openings in said body, said openings being separated from said compartment by a wall unitary with said body;

a pair of male/female contact members in said openings with one of said pair being divided into two electrically isolated segments; and, a pair of fuse connectors each forming electrical communication between a respective contact cap and a corresponding segment, each segment including a securement means and each fuse connector comprising a connector strip of resilient electrically conductive material having an engagement end extending through said wall to connect with said securement means, each segment comprising a resilient contact strip of electrically conductive material configured in a predetermined shape, said securement means comprising an end portion of said contact strip angularly bent into inclined tabs to form a frictional connection with said engagement end, said connector strip being folded into a wedge shape having an apex that comprises said engagement end.

* * * * *